US008653387B2

(12) United States Patent
Bessette et al.

(10) Patent No.: US 8,653,387 B2
(45) Date of Patent: Feb. 18, 2014

(54) ROTARY ADJUSTMENT FOR DUAL SWITCH ASSEMBLY

(75) Inventors: Tyler Bessette, Shelton, CT (US); David Dlugos, Beacon Falls, CT (US)

(73) Assignee: Ashcroft, Inc., Stratford, CT (US)

( * ) Notice: Subject to any disclaimer, the term of this patent is extended or adjusted under 35 U.S.C. 154(b) by 855 days.

(21) Appl. No.: 12/831,606

(22) Filed: Jul. 7, 2010

(65) Prior Publication Data

US 2012/0007732 A1 Jan. 12, 2012

(51) Int. Cl.
*H01H 35/26* (2006.01)

(52) U.S. Cl.
USPC ..... 200/83 S; 200/81.4; 200/81.9 R; 200/83 A; 200/83 B; 200/83 J; 200/83 Q; 200/83 SA; 200/83 Z; 340/544; 340/626; 73/431; 73/756

(58) Field of Classification Search
USPC ..... 200/81.4, 83 A, 83 B, 83 J, 83 Q, 83 S, 200/83 Z, 81.9 R, 83 SA; 73/431, 756; 340/544, 626
See application file for complete search history.

(56) References Cited

U.S. PATENT DOCUMENTS

| | | | | |
|---|---|---|---|---|
| 4,048,455 | A | 9/1977 | Forsythe et al. | |
| 4,243,857 | A | 1/1981 | Reis | |
| 4,326,627 | A | 4/1982 | Massey et al. | |
| 4,467,155 | A | 8/1984 | Grudzien, Jr. | |
| 4,742,195 | A | 5/1988 | Bryant et al. | |
| 4,783,580 | A | 11/1988 | Bassin | |
| 4,851,627 | A | 7/1989 | Sakakino et al. | |
| 5,004,873 | A | 4/1991 | Schnut | |
| 5,204,511 | A | 4/1993 | Baitz | |
| 5,278,530 | A | 1/1994 | Zovath | |
| 5,483,856 | A | 1/1996 | Smitterberg et al. | |
| 6,242,909 | B1 | 6/2001 | Dorsey et al. | |
| 6,286,810 | B1 * | 9/2001 | Dole et al. | 251/304 |
| 6,545,662 | B1 | 4/2003 | Noll et al. | |
| 2007/0187172 | A1 | 8/2007 | Kaneda et al. | |
| 2009/0026055 | A1 | 1/2009 | Skarlupka | |

OTHER PUBLICATIONS

PCT International Search Report and Written Opinion dated Nov. 16, 2011.

* cited by examiner

*Primary Examiner* — Andrew Bee
(74) *Attorney, Agent, or Firm* — McCarter & English, LLP

(57) ABSTRACT

The present disclosure provides for systems and methods for fabricating sensing and/or control device assemblies, e.g., a dual pressure switch sensing and/or control device, a dual temperature switch sensing and/or control device or the like. More particularly, the present disclosure provides for systems and methods for fabricating sensing and/or control device assemblies (e.g., dual switch sensing and/or control device assemblies) with adjustment features and/or functionalities for switch calibration and/or adjustment. In one embodiment, the present disclosure provides for systems and methods for fabricating sensing and/or control device assemblies (e.g., dual switch sensing and/or control device assemblies) with rotary adjustment features/functionalities wherein the switches of the sensing device may be calibrated or adjusted via the rotary adjustment features/functionalities.

30 Claims, 5 Drawing Sheets

ROTARY ADJUSTMENT FOR DUAL SWITCH ASSEMBLY

BACKGROUND

1. Technical Field

The present disclosure relates to a sensing and/or control device assembly and method for fabricating sensing/control device assemblies and, more particularly, to sensing/control device assemblies (e.g., dual switch sensing/control device assemblies) with adjustment features and/or functionalities (e.g. rotary adjustment features/functionalities) for switch calibration and/or adjustment.

2. Background Art

Sensing and/or control devices, such as pressure switches or temperature switches, have innumerable uses in industry. For example, pressure or temperature switches to sense or detect when a specified pressure or temperature has been reached in a process media, device or system are well known. Sensing/control devices are useful in a myriad of different environments for commercial and industrial applications. Typically, a pressure or temperature switch is an electrical switch that is responsive to pressure or temperature changes.

In general, dual switch sensing/control devices (e.g., a dual pressure switch sensing/control device, or a dual temperature switch sensing/control device or the like) may be utilized as dedicated switches for safety and/or pressure/temperature monitoring of industrial systems or vessels. For example, dual pressure switch sensing/control devices may be utilized in a system to protect the system from excessively low or high system pressure (e.g., as a pump guard to control and protect supply pumps). Typical applications of dual pressure or temperature switch sensing/control devices include serving as safety shutdown switches or actuating a visual or audible signal when set-points are exceeded.

Price competition between the various sensing/control device manufacturers is a factor in the marketplace. Therefore, a savings in the cost of material, labor and the like by a manufacturer can have a significant effect on that manufacturer's sales, market share and margins. Therefore, a constant need exists among these manufacturers to develop more cost effective manufacturing techniques.

Typically, the switches of conventional dual switch sensing/control devices do not change state at the same time/sensed condition due to manufacturer tolerances in the switches/actuators. In general, some conventional dual switch sensing/control devices utilize some methods to attempt to make the switches of the devices operate in tandem. For example, some conventional devices employ a Belleville style spring washer or the like which snaps at a specified condition (e.g., a specified pressure or temperature). This snap action generally hits the switches in unison. See, for example, U.S. Pat. No. 4,243,857 to Reis.

Other manufacturers use a diaphragm system, typically in conjunction with a mechanical tongue. The tongue can be twisted side to side, effectively raising or lowering the actuators that hit each switch. In general, a point can typically be found where both switches act substantially together.

However, the Belleville design adds several parts and therefore cost and complexity. The diaphragm and tongue approach also adds parts and is typically very time consuming to adjust. Other conventional methods of changing the relative heights of the switches can also be time consuming and add cost/complexity to the devices. See, e.g., U.S. Pat. No. 4,243,857 to Reis.

Thus, despite efforts to date, a need remains for cost effective and efficient systems/methods that provide for improved sensing/control devices. More particularly, a need remains for improved systems/methods that provide for sensing/control device assemblies with adjustment features (e.g., rotary adjustment features) wherein the switch or switches of the sensing/control device may be calibrated or adjusted via the adjustment features. These and other inefficiencies and opportunities for improvement are addressed and/or overcome by the systems and methods of the present disclosure.

SUMMARY

The present disclosure provides an advantageous sensing and/or control device assembly and method for fabricating advantageous sensing/control device assemblies. In exemplary embodiments, the present disclosure provides for improved systems and methods for fabricating sensing/control device assemblies (e.g., a dual pressure switch sensing/control device, a dual temperature switch sensing/control device or the like) with advantageous adjustment features and/or functionalities for switch calibration and/or adjustment. In one embodiment, the present disclosure provides for systems and methods for fabricating sensing/control device assemblies (e.g., dual switch sensing/control device assemblies) with advantageous rotary adjustment features wherein the switch or switches of the sensing/control device may be calibrated or adjusted via the rotary adjustment features.

The present disclosure provides for a sensing device including a first housing attached to a coupling having an inlet, the first housing configured to house at least in part a condition responsive actuatable sensing element, the actuatable sensing element having a first end and a second end, the first end in communication with the inlet; a second housing mounted with respect to the first housing, the second housing configured to house at least in part an electrical mounting member, the electrical mounting member having at least one switch secured thereto, the at least one switch including a switch actuator; wherein the electrical mounting member is configured to rotate with respect to the second housing to thereby adjust the height of the switch actuator relative to the second end of the actuatable sensing element.

The present disclosure also provides for a sensing device wherein the first and second housings are substantially cylindrical, and the electrical mounting member is substantially circular. The present disclosure also provides for a sensing device wherein the actuatable sensing element is selected from the group consisting of an actuatable sensing diaphragm, an actuatable sensing bellows and an actuatable sensing piston. The present disclosure also provides for a sensing device wherein the electrical mounting member is a printed circuit board.

The present disclosure also provides for a sensing device wherein the at least one switch is a pressure switch or a temperature switch. The present disclosure also provides for a sensing device wherein the second housing further includes a groove configured to house at least a portion of the electrical mounting member. The present disclosure also provides for a sensing device wherein the second housing has a proximal side defining a first horizontal plane and a bottom side defining a second horizontal plane, and wherein the groove is angled relative to at least one of the first and second horizontal planes.

The present disclosure also provides for a sensing device wherein the groove is angled from about 0.25 degrees to about 0.75 degrees relative to at least one of the first and second horizontal planes. The present disclosure also provides for a sensing device wherein the first and second horizontal planes are substantially parallel. The present disclosure also provides for a sensing device wherein the groove travels approximately 360° around the inner portion of the second housing.

The present disclosure also provides for a sensing device including a first housing attached to a coupling having an inlet, the first housing configured to house at least in part a condition responsive actuatable sensing element, the actuatable sensing element having a first end and a second end, the first end in communication with the inlet; a second housing mounted with respect to the first housing, the second housing configured to house at least in part an electrical mounting member, the electrical mounting member having a first switch and a second switch secured thereto, the first switch including a first switch actuator and the second switch including a second switch actuator; wherein the electrical mounting member is configured to rotate with respect to the second housing to thereby adjust the heights of the first and second switch actuators relative to: (i) one another, and (ii) the second end of the actuatable sensing element.

The present disclosure also provides for a sensing device wherein the first and second housings are substantially cylindrical, and the electrical mounting member is substantially circular. The present disclosure also provides for a sensing device wherein the actuatable sensing element is selected from the group consisting of an actuatable sensing diaphragm, an actuatable sensing bellows and an actuatable sensing piston. The present disclosure also provides for a sensing device wherein the electrical mounting member is a printed circuit board.

The present disclosure also provides for a sensing device wherein the first and second switches are pressure switches or temperature switches. The present disclosure also provides for a sensing device wherein the second housing further includes a groove configured to house at least a portion of the electrical mounting member. The present disclosure also provides for a sensing device wherein the second housing has a proximal side defining a first horizontal plane and a bottom side defining a second horizontal plane, and wherein the groove is angled relative to at least one of the first and second horizontal planes.

The present disclosure also provides for a sensing device wherein the groove is angled from about 0.25 degrees to about 0.75 degrees relative to at least one of the first and second horizontal planes. The present disclosure also provides for a sensing device wherein the first and second horizontal planes are substantially parallel. The present disclosure also provides for a sensing device wherein the groove travels approximately 360° around the inner portion of the second housing. The present disclosure also provides for a sensing device wherein the actuatable sensing element is configured to actuate in response to condition changes: (i) received at the inlet and (ii) to which the actuatable sensing element is sensitive; and wherein the rotation of the electrical mounting member allows a user to adjust the heights of the first and second switch actuators to a position where the first and second switch actuators change state at substantially the same time upon actuation of the actuatable sensing element.

The present disclosure also provides for a sensing device wherein the first and second switch actuators change state within a tolerance of about 0.00005 inches height difference between the first and second switch actuators relative to the second end of the actuatable sensing element.

The present disclosure also provides for a method for fabricating a sensing device including providing a first housing attached to a coupling having an inlet, the first housing configured to house at least in part a condition responsive actuatable sensing element, the actuatable sensing element having a first end and a second end, the first end in communication with the inlet; providing a second housing mounted with respect to the first housing, the second housing configured to house at least in part an electrical mounting member, the electrical mounting member having a first switch and a second switch secured thereto, the first switch including a first switch actuator and the second switch including a second switch actuator; rotating the electrical mounting member with respect to the second housing to thereby adjust the heights of the first and second switch actuators relative to: (i) one another, and (ii) the second end of the actuatable sensing element; securing the second housing relative to the first housing after the desired position of the electrical mounting member has been determined by a user; and securing the electrical mounting member with respect to the second housing after the desired position of the electrical mounting member has been determined by the user.

The present disclosure also provides for a method for fabricating a sensing device wherein the second housing further includes a groove configured to house at least a portion of the electrical mounting member. The present disclosure also provides for a method for fabricating a sensing device wherein the second housing has a proximal side defining a first horizontal plane and a bottom side defining a second horizontal plane, and wherein the groove is angled relative to at least one of the first and second horizontal planes. The present disclosure also provides for a method for fabricating a sensing device wherein the groove is angled from about 0.25 degrees to about 0.75 degrees relative to at least one of the first and second horizontal planes.

The present disclosure also provides for a method for fabricating a sensing device wherein the groove travels approximately 360° around the inner portion of the second housing. The present disclosure also provides for a method for fabricating a sensing device wherein the actuatable sensing element is configured to actuate in response to condition changes: (i) received at the inlet and (ii) to which the actuatable sensing element is sensitive; and wherein the desired position of the electrical mounting member allows the first and second switch actuators to change state at substantially the same time upon actuation of the actuatable sensing element.

The present disclosure also provides for a method for fabricating a sensing device wherein the first and second switch actuators change state within a tolerance of about 0.00005 inches height difference between the first and second switch actuators relative to the second end of the actuatable sensing element. The present disclosure also provides for a method for fabricating a sensing device wherein the electrical mounting member is secured with respect to the second housing by sealing the electrical mounting member with a sealant.

Additional advantageous features, functions and applications of the disclosed devices, systems and methods of the present disclosure will be apparent from the description which follows, particularly when read in conjunction with the appended figures.

BRIEF DESCRIPTION OF THE DRAWINGS

To assist those of ordinary skill in the art in making and using the disclosed devices, systems and methods of the present disclosure, reference is made to the appended figures, wherein.

DETAILED DESCRIPTION

Figure 1:
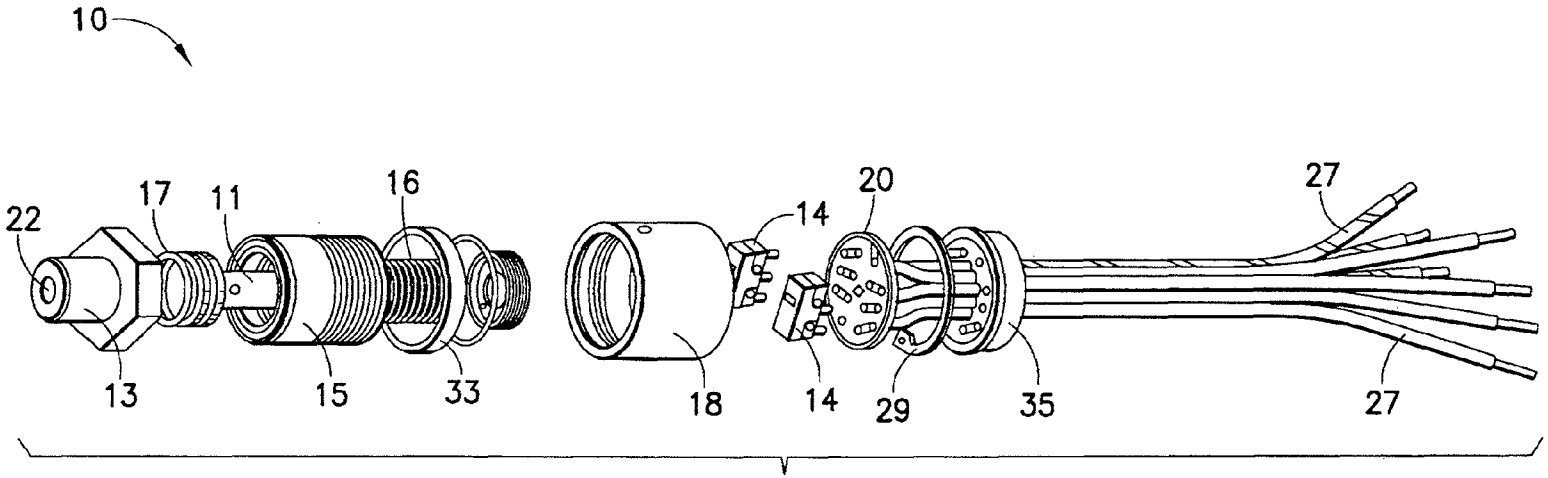
FIG. 1 is an exploded side perspective view of an exemplary sensing and/or control device according to the present disclosure, prior to assembly.

In the description which follows, like parts are marked throughout the specification and drawings with the same reference numerals, respectively. Drawing figures are not necessarily to scale and in certain views, parts may have been exaggerated for purposes of clarity.

The present disclosure provides for improved systems and methods for fabricating sensing and/or control device assemblies, e.g., a dual pressure switch sensing/control device, a dual temperature switch sensing/control device or the like. More particularly, the present disclosure provides for systems and methods for fabricating sensing/control device assemblies (e.g., dual switch sensing/control device assemblies) with improved adjustment features and/or functionalities for switch calibration and/or adjustment. In an exemplary embodiment, the present disclosure provides for systems and methods for fabricating sensing/control device assemblies (e.g., dual switch sensing/control device assemblies) with advantageous rotary adjustment features/functionalities wherein the switch or switches of the sensing/control device may be calibrated or adjusted via the rotary adjustment features/functionalities.

Current practice provides that the typical sensing and/or control device manufacturer may be required to utilize costly and/or complex parts and/or methods to ensure that the switches of the devices operate substantially in tandem, as the switches of conventional dual switch sensing/control devices generally do not change state at the same time/sensed condition due to manufacturer tolerances in the components. For example, some devices utilize a Belleville spring assembly or the like that snaps at a specified condition (e.g., a specified pressure or temperature). This approach adds several parts and is costly, complex and inefficient. Other devices employ a diaphragm/tongue system, and the tongue is typically twisted side to side, thereby raising or lowering the actuators that hit each switch. However, this approach also adds costly and/or complex parts, and it is typically very time consuming and labor intensive to adjust such devices. Moreover, other typical methods of changing the relative heights of the switches are also generally time consuming and add cost/complexity to the devices.

In exemplary embodiments, the present disclosure provides for improved systems/methods for fabricating sensing and/or control device assemblies (e.g., dual switch sensing/control device assemblies) with advantageous adjustment features and/or functionalities for switch calibration/adjustment, and wherein the systems/methods do not add costly and/or complex parts to the device, thereby reducing the cost of manufacture and providing a significant commercial advantage as a result. Additionally, the improved systems/methods of the present disclosure also allow the switch or switches of the sensing/control devices to be quickly and efficiently calibrated or adjusted via the adjustment features/functionalities without undue time/labor, thereby providing a significant manufacturing and commercial advantage as a result.

Figure 2:
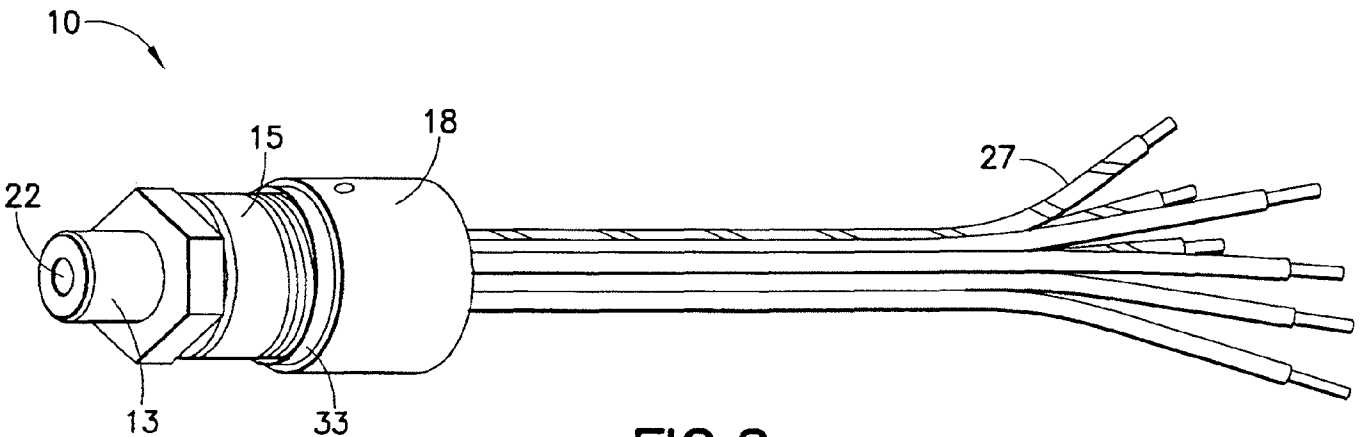
FIG. 2 is a side perspective view of the device of FIG. 1, after assembly.

Referring now to the drawings, and in particular to FIGS. 1-2, there is illustrated a sensing and/or control device 10 depicting an embodiment of the present disclosure. For example, device 10 may be a dual switch sensing/control device (e.g., a dual switch assembly), including, but not limited to, a dual pressure switch sensing/control device. In another embodiment, device 10 is a dual temperature switch sensing/control device. However, dual pressure or temperature switch sensing/control devices are not the only sensing/control devices that could be used in accordance with the principles of the present disclosure, as will be readily apparent to persons skilled in the art from the description provided herein.

In general, device 10, via fitting or coupling 13 (e.g., a pressure fitting), is operably coupled or mounted with respect to a system and/or container such as a tank, a pipe, a pressurized reactor or the like from which (or for which) conditions (e.g., pressure, temperature, etc.) are to be sensed and/or monitored. Typically, fitting 13 includes a fitting inlet 22. For example, fitting inlet 22 may be connected to an appropriate condition source opening, and the condition to be sensed/monitored (e.g., fluid pressure) received at fitting inlet 22 is communicated to a condition responsive actuatable sensing element 11 (e.g., a sensing/monitoring actuator mechanism). In general, sensing/control device 10 allows a condition to be sensed or monitored (whether it be pressure, temperature or some other condition) by the condition responsive actuatable sensing element 11 (e.g., an actuatable sensing diaphragm, an actuatable sensing bellows, or an actuatable sensing piston or the like). Condition responsive actuatable sensing element 11 is typically configured to produce motion in response to condition changes to which the actuatable sensing element 11 is sensitive (e.g., pressures, temperatures, etc. received at fitting inlet 22). For example, element 11 may rise with pressure or temperature (e.g., the condition to be sensed), and exemplary sensing element 11 may travel from about 0.010 inches to about 0.015 inches when actuated.

In exemplary embodiments, actuatable sensing element 11 is configured and dimensioned to actuate or move when a specified condition (e.g., a specified pressure or temperature) of the monitored system has been reached, with the subsequent actuation or movement of sensing element 11 thereby actuating at least one switch 14 of device 10. For example, the actuation of the at least one switch 14 may serve as a safety shutdown switch and/or actuate a visual or audible signal when a set-point of the condition to be monitored is exceeded.

In general, actuatable sensing element 11 and a spring 16 are both at least partially housed and/or positioned within sensing element housing 15. In exemplary embodiments, sensing element housing 15 is substantially cylindrical.

Figure 3:
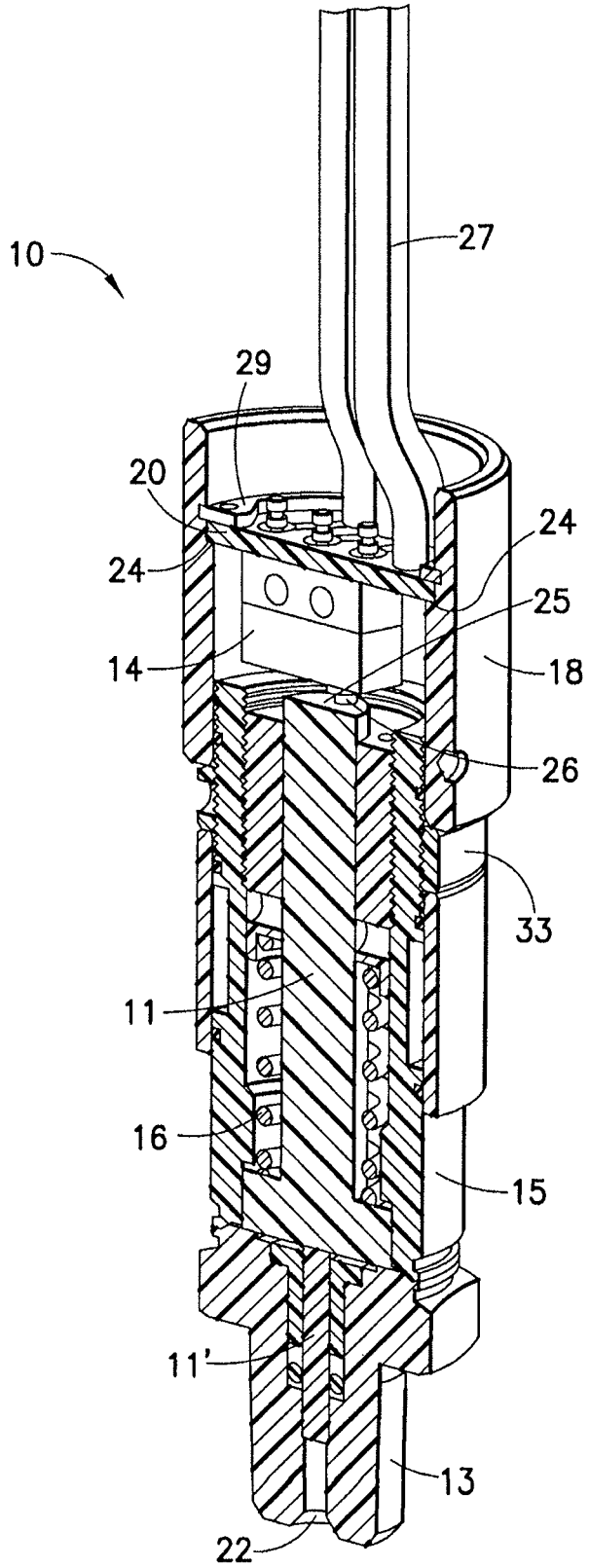
FIG. 3 is a partial cross-sectional side view of another exemplary sensing/control device according to the present disclosure.

In one embodiment and as shown in FIG. 1, actuatable sensing element 11 is a piston that includes a piston O-ring or gasketing material 17. In another embodiment and as shown in FIG. 3, actuatable sensing element 11 includes a first elongated member (e.g., a pushrod or the like) and also includes a second elongated member 11' (e.g., a sensing piston) positioned at least in part in the fitting 13. Fitting 13 is typically securely or releasably attached, secured or fastened to sensing element housing 15 (e.g., via welding or via cooperating threads).

As noted, device 10 typically includes at least one actuatable switch 14. As shown in FIGS. 1-6, device 10 typically includes two switches 14 (e.g., dual pressure switches, dual temperature switches, etc.), although the present disclosure is not limited thereto. Alternatively, device 10 may include one switch 14, or may include a plurality of switches 14. Each switch 14 typically includes at least one switch actuator 26 (e.g., switch plunger or the like).

In exemplary embodiments, switches 14 are electrical switches that are responsive to condition changes (e.g., via actuatable sensing element 11). In general, upon actuation of the switch actuators or plungers 26 of switches 14 via the substantially flat top surface or plane 25 of actuatable sensing element 11, switches 14 may for example serve as safety shutdown switches or actuate a visual and/or audible signal (e.g., when pre-defined pressure or temperature set-points are exceeded). Typically, upon actuation of element 11 (e.g., element 11 rises with pressure or temperature), the substantially flat top side or surface area 25 of element 11 hits the switch actuators 26 thereby causing the switches to change state (e.g., normally open changes to normally closed). However, the switches of conventional dual switch sensing/control devices typically do not change state at the same time/sensed condition due to manufacturer tolerances in the components. The present disclosure advantageously allows for an efficient and inexpensive adjustment that allows a user to quickly and accurately adjust/calibrate the switches 14 (and/or element 11) so that the switches 14 of device 10 change state at substantially the same time (e.g., within a tolerance of 0.00005 inches) upon actuation of element 11.

Device 10 also typically includes switch housing, enclosure or holder 18 that is configured and dimensioned to house, contain and/or enclose the at least one switch 14. As shown in FIGS. 1-6, exemplary switch housing 18 houses dual switches 14. In exemplary embodiments, switch housing 18 is substantially cylindrical.

Figure 4:
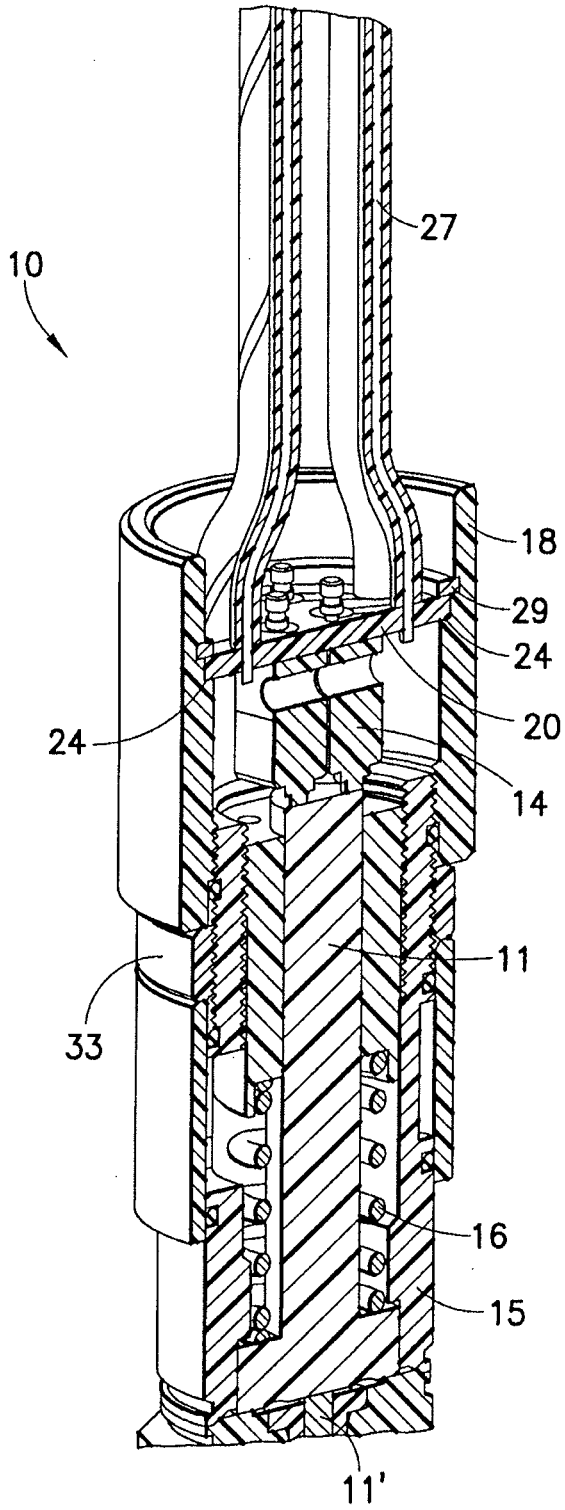
FIG. 4 is another partial cross-sectional side view of the device of FIG. 3.
Figure 5:
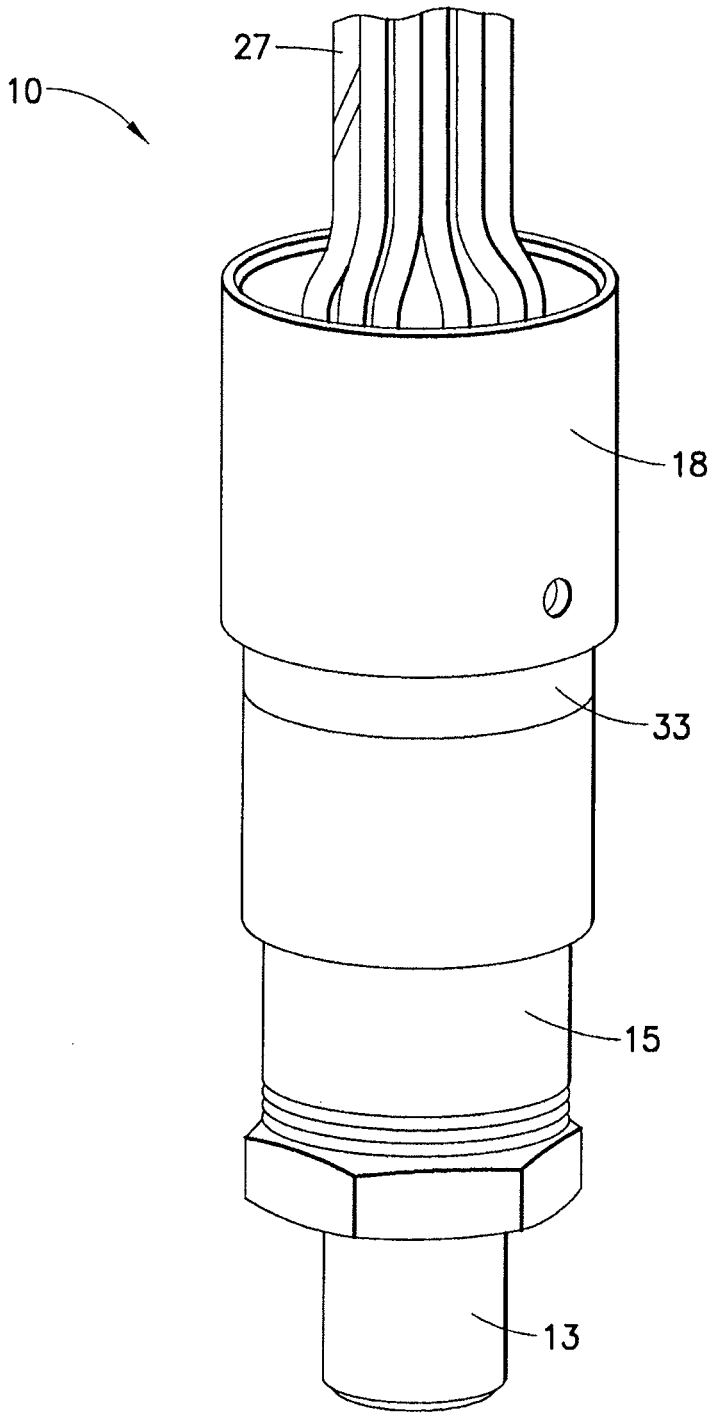
FIG. 5 is a side perspective view of the device of FIG. 3.
Figure 6:
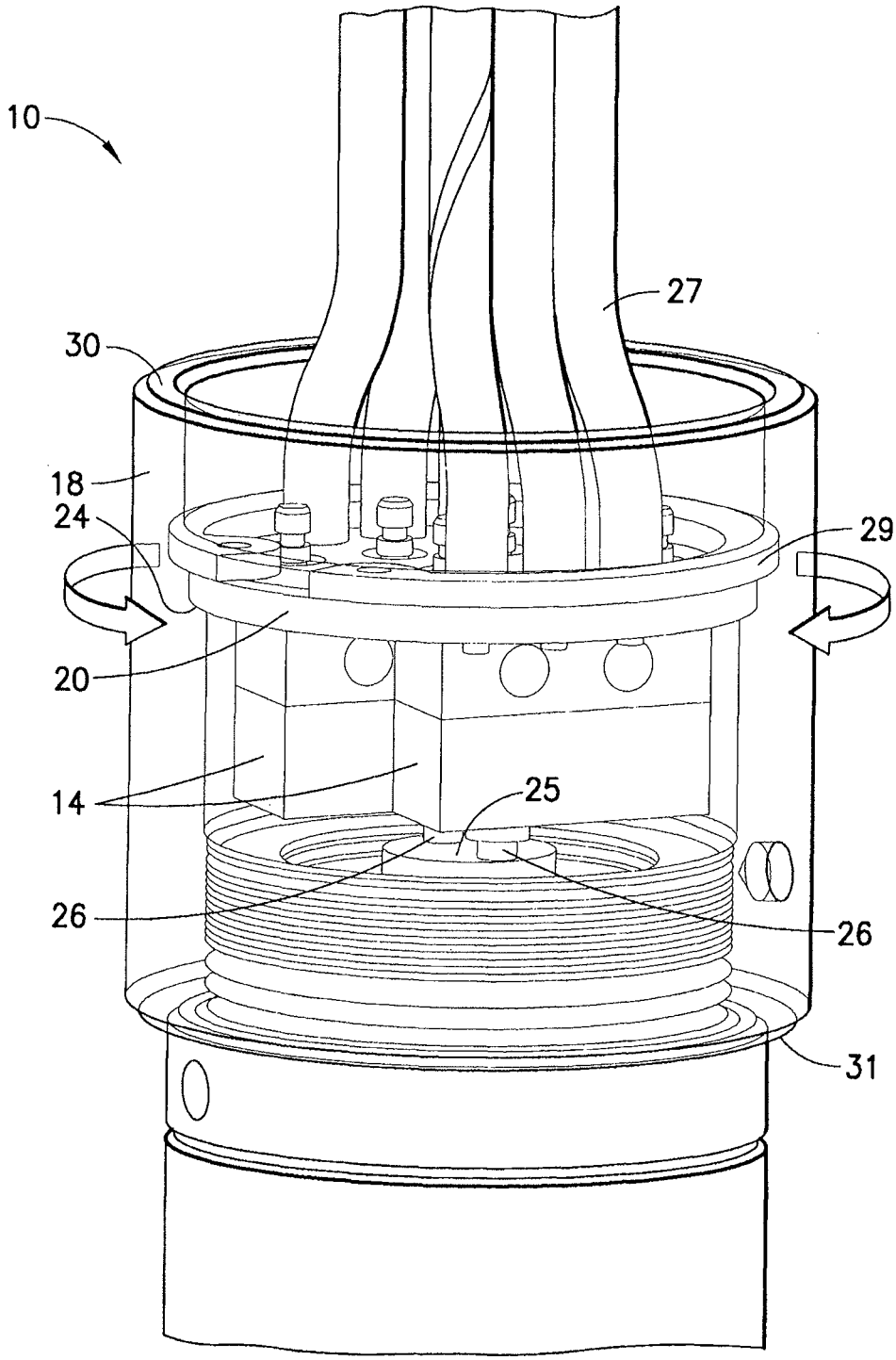
FIG. 6 is an exploded, partial side perspective view of the device of FIG. 3 depicting the external and internal components of the switch housing of the device.

Each switch 14 is typically secured (e.g., soldered) or mounted with respect to an electrical mounting member 20 (e.g., a printed circuit board or PCB). Exemplary electrical mounting member 20 takes the form of a substantially circular PCB, although the present disclosure is not limited thereto. Rather, electrical mounting member 20 can take a variety of forms. In general and as shown in FIGS. 3-4, switches 14 are secured to the distal or bottom side of electrical mounting member 20. Wires 27 are typically secured to the proximal or top side of member 20.

In exemplary embodiments and as further discussed below, prior to final assembly of device 10, electrical mounting member 20 is typically configured and dimensioned to be movable (e.g., rotationally movable) within and/or with respect to switch housing 18 to allow switches 14 to be calibrated and/or adjusted (e.g., to allow the heights of the switches 14/switch actuators 26 to be adjusted relative to one another and/or relative to the top surface 25 of actuatable sensing element 11). For example, prior to final assembly of device 10, substantially circular electrical mounting member 20 (e.g., dual switch board or PCB) with dual switches 14 (e.g., two single pole, double throw switches side by side) secured thereto may be rotated or rotationally moved within and with respect to switch housing 18 (and/or with respect to top surface 25 of sensing element 11) to allow the heights of the switches 14/switch actuators 26 to be adjusted relative to one another and relative to the top surface 25 of actuatable sensing element 11. As such, a user may calibrate or adjust (e.g., via the rotary adjustment or rotational movement of PCB 20) the relative heights of both switches 14/switch actuators 26 to determine a position of switches 14/switch actuators 26 and of member 20 where the two switches 14/switch actuators 26 are actuated at substantially the same time by the top surface 25 of sensing element 11 when sensing element 11 is actuated. Such calibration or adjustment of device 10 may be accomplished for either decreasing or increasing conditions (e.g., decreasing or increasing pressures).

In exemplary embodiments, the rotary adjustment of member 20 allows a user to adjust the heights of switches 14/switch actuators 26 to a position where both switches 14/switch actuators 26 actuate (e.g., change state) at substantially the same time upon actuation of sensing element 11 and within a tolerance of about 0.00005 inches height difference between the two switches 14/switch actuators 26 (e.g., relative to the top surface or plane 25 of sensing element 11). In other words, both switches 14 will change state at the same time within a tolerance of 0.00005 inches.

In an alternative embodiment, member 20 includes one switch 14 secured thereto, and prior to final assembly of device 10, member 20 may be rotated or rotationally moved within and with respect to switch housing 18 (and/or with respect to top surface 25 of sensing element 11) to allow the height of the switch 14/switch actuator 26 to be adjusted relative to the top surface 25 of actuatable sensing element 11. In another alternative embodiment, member 20 includes three or more switches 14, and prior to final assembly of device 10, member 20 may be rotated within and with respect to switch housing 18 (and/or with respect to top surface 25 of sensing element 11) to allow the heights of the switches 14/switch actuators 26 to be adjusted relative to one another and relative to the top surface 25 of actuatable sensing element 11 (e.g., to allow the three or more switches 14/switch actuators 26 to actuate at substantially the same time by the top surface 25 of sensing element 11 when sensing element 11 is actuated).

In general, switch housing 18 includes a groove 24 that has been machined, fabricated or cut into at least a portion of switch housing 18. Typically, groove 24 is configured and dimensioned to house, seat and/or contain at least a portion of electrical mounting member 20 and to allow member 20 to be moved (e.g., rotationally moved), prior to final assembly of device 10, while member 20 is positioned at least in part in groove 24. In an exemplary embodiment, groove 24 (e.g., an angled groove) travels inside, through and around the inner portion of the substantially cylindrical switch housing 18 (e.g., groove 24 travels approximately 360° inside, through and around the inner perimeter or portion of switch housing 18). Typically a retaining member 29 (e.g., snap retaining ring, threaded ring, spring clip, etc.) is utilized to ensure that member 20 is maintained in the groove 24.

In one embodiment, groove 24 is an angled groove that travels approximately 360° around the inner portion of housing 18. Switch housing 18 typically includes a proximal or top side 30 defining a first horizontal plane and a bottom side 31 defining a second horizontal plane, with the first and second horizontal planes typically being substantially parallel, and wherein angled groove 24 is fabricated or machined to be angled (e.g., from about 0.25 degrees to about 0.75 degrees) relative to the first and second horizontal planes. In another embodiment, the first and second horizontal planes are not substantially parallel, and the angled groove is fabricated to be angled (e.g., from about 0.25 degrees to about 0.75 degrees) relative to either the first horizontal plane or to the second horizontal plane. As such and prior to final assembly of device 10, member 20 positioned at least in part in angled groove 24 is free to be rotated or rotationally moved within angled groove 24 and within, around and with respect to housing 18 so that a position may be located to determine a position of switches 14/switch actuators 26 and of member 20 where the switches 14/switch actuators 26 are actuated at substantially the same time by the top surface 25 of sensing element 11 when sensing element 11 is actuated. In other words, prior to final assembly of device 10, substantially circular electrical mounting member 20 (e.g., dual switch board or PCB with dual switches 14 secured thereto) positioned at least in part in angled groove 24 is free to be rotated or rotationally moved within angled groove 24 and within, around and with respect to housing 18 (and/or with respect to top surface 25 of sensing element 11) to allow the heights of the switches 14/switch actuators 26 to be adjusted relative to one another and relative to the top surface 25 of actuatable sensing element 11. In exemplary embodiments, during rotation of member 20, when one switch 14 is dropping down towards top surface 25 of element 11 (i.e., towards the bottom side 31 defining the second horizontal plane), the other switch 14 is rising up away from the top surface 25 and towards the top side 30 defining the first horizontal plane. In this way, a user may calibrate or adjust (e.g., via the rotary adjustment or rotational movement of PCB 20) the relative heights of both switches 14/switch actuators 26 to determine a position of switches 14/switch actuators 26 and of member 20 where the two switches 14/switch actuators 26 are actuated at substantially the same time by the top surface 25 of sensing element 11 when sensing element 11 is actuated.

In alternative embodiments and as similarly discussed above, member 20 positioned at least in part in groove 24 may include one switch 14 secured thereto, and prior to final assembly of device 10, member 20 may be rotated or rotationally moved within and with respect to switch housing 18 (and/or with respect to top surface 25 of sensing element 11) to allow the height of the switch 14/switch actuator 26 to be adjusted relative to the top surface 25 of actuatable sensing element 11. In another alternative embodiment, member 20 positioned at least in part in groove 24 may include three or more switches 14, and prior to final assembly of device 10, member 20 may be rotated within and with respect to switch housing 18 (and/or with respect to top surface 25 of sensing element 11) to allow the heights of the switches 14/switch actuators 26 to be adjusted relative to one another and relative to the top surface 25 of actuatable sensing element 11 (e.g., to allow the three or more switches 14/switch actuators 26 to actuate at substantially the same time by the top surface 25 of sensing element 11 when sensing element 11 is actuated).

In another alternative embodiment of the present disclosure, groove 24 (e.g., an angled groove) is machined, fabricated or cut into at least a portion of a separate electrical mounting member carrier or holder or the like (e.g., a substantially cylindrical carrier or holder). The electrical mounting member carrier or holder or the like having the groove 24 may then be positioned at least partially within the housing 18 so that the member 20 may be positioned at least in part in the groove 24. Thus, member 20 is free to be rotated or rotationally moved (prior to final assembly) within angled groove 24 and within, around and with respect to the carrier and/or to housing 18 so that a position may be located to determine a position of switches 14/switch actuators 26 and of member 20 where the switches 14/switch actuators 26 are actuated at substantially the same time by sensing element 11 when sensing element 11 is actuated.

In another embodiment, instead of or in addition to positioning the member 20 containing the switches 14 in angled groove 24, the top surface 25 may be angled (e.g., via grinding top surface 25), and by rotating element 11 in the housing 15 (and with respect to housing 15) a position where the switches 14/switch actuators 26 are actuated at substantially the same time by the top surface 25 of sensing element 11 when sensing element 11 is actuated can be found by a user (or as a way to adjust the height of a single switch 14 relative to top surface 25).

In exemplary embodiments of the present disclosure, after calibration or adjustment of the switch or switches 14 (or of element 11) to the desired position, typically a locking ring 33 or the like is rotated in place around sensing element housing 15 and/or switch housing 18 to secure switch housing 18 relative to sensing element housing 15, and a sealant 35 (e.g., epoxy sealant or epoxy fill or the like) is added or inserted to the top surface 30 of housing 18 and/or member 20 to cover and hold the member 20 in the desired position.

Whereas the disclosure has been described principally in connection with a dual pressure switch assembly or a dual temperature switch assembly, such descriptions have been utilized only for purposes of disclosure and are not intended as limiting the disclosure. To the contrary, it is to be recognized that the adjustment features (e.g., rotary adjustment features) may be utilized in conjunction with other sensing/control device assemblies (e.g., with other switch assemblies to adjust/calibrate the switch/switches and/or sensing element of the assemblies via the adjustment features).

Although the systems and methods of the present disclosure have been described with reference to exemplary embodiments thereof, the present disclosure is not limited to such exemplary embodiments and/or implementations. Rather, the devices, systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A sensing device comprising:

a first housing attached to a coupling having an inlet, the first housing configured to house at least in part a condition responsive actuatable sensing element, the actuatable sensing element having a first end and a second end, the first end in communication with the inlet;

a second housing mounted with respect to the first housing, the second housing including a groove configured to house at least in part an electrical mounting member, the electrical mounting member: (i) having a top side and a bottom side, and (ii) having at least one switch secured to the bottom side of the electrical mounting member, the at least one switch including a switch actuator;

wherein the second housing has a proximal side defining a first horizontal plane and a bottom side defining a second horizontal plane, and wherein the groove is angled relative to at least one of the first and second horizontal planes; and wherein the electrical mounting member is configured to be positioned within the angled groove and rotated within the angled groove without being moved in the axial direction of the electrical mounting member and with respect to the second housing to thereby adjust the height of the switch actuator relative to the second end of the actuatable sensing element.

2. The device of claim 1, wherein the first and second housings are substantially cylindrical, and the electrical mounting member is substantially circular.

3. The device of claim 1, wherein the actuatable sensing element is selected from the group consisting of an actuatable sensing diaphragm, an actuatable sensing bellows and an actuatable sensing piston.

4. The device of claim 1, wherein the electrical mounting member is a printed circuit board.

5. The device of claim 1, wherein the at least one switch is a pressure switch or a temperature switch.

6. The device of claim 1 further comprising a retaining member positioned above the electrical mounting member, the retaining member configured and dimensioned to maintain the electrical mounting member in the groove.

7. The device of claim 6, wherein the retaining member is a retaining ring or a spring clip.

8. The device of claim 1, wherein the groove is angled from about 0.25 degrees to about 0.75 degrees relative to at least one of the first and second horizontal planes.

9. The device of claim 1, wherein the first and second horizontal planes are substantially parallel.

10. The device of claim 1, wherein the groove travels approximately 360° around the inner portion of the second housing.

11. A sensing device comprising:

a first housing attached to a coupling having an inlet, the first housing configured to house at least in part a condition responsive actuatable sensing element, the actuatable sensing element having a first end and a second end, the first end in communication with the inlet;

a second housing mounted with respect to the first housing, the second housing including a groove configured to house at least in part an electrical mounting member, the electrical mounting member: (i) having a top side and a bottom side, and (ii) having a first switch and a second switch secured to the bottom side of the electrical mounting member, the first switch including a first switch actuator and the second switch including a second switch actuator;

wherein the second housing has a proximal side defining a first horizontal plane and a bottom side defining a second horizontal plane, and wherein the groove is angled relative to at least one of the first and second horizontal planes; and wherein the electrical mounting member is configured to be positioned within the angled groove and rotated within the angled groove without being moved in the axial direction of the electrical mounting member and with respect to the second housing to thereby adjust the heights of the first and second switch actuators relative to: (i) one another, and (ii) the second end of the actuatable sensing element.

12. The device of claim 11, wherein the first and second housings are substantially cylindrical, and the electrical mounting member is substantially circular.

13. The device of claim 11, wherein the actuatable sensing element is selected from the group consisting of an actuatable sensing diaphragm, an actuatable sensing bellows and an actuatable sensing piston.

14. The device of claim 11, wherein the electrical mounting member is a printed circuit board.

15. The device of claim 11, wherein the first and second switches are pressure switches or temperature switches.

16. The device of claim 11, further comprising a retaining member positioned above the electrical mounting member, the retaining member configured and dimensioned to maintain the electrical mounting member in the groove.

17. The device of claim 16, wherein the retaining member is a retaining ring or a spring clip.

18. The device of claim 11, wherein the groove is angled from about 0.25 degrees to about 0.75 degrees relative to at least one of the first and second horizontal planes.

19. The device of claim 11, wherein the first and second horizontal planes are substantially parallel.

20. The device of claim 11, wherein the groove travels approximately 360° around the inner portion of the second housing.

21. The device of claim 11, wherein the actuatable sensing element is configured to actuate in response to condition changes: (i) received at the inlet and (ii) to which the actuatable sensing element is sensitive; and wherein the rotation of the electrical mounting member allows a user to adjust the heights of the first and second switch actuators to a position where the first and second switch actuators change state at substantially the same time upon actuation of the actuatable sensing element.

22. The device of claim 21, wherein the first and second switch actuators change state within a tolerance of about 0.00005 inches height difference between the first and second switch actuators relative to the second end of the actuatable sensing element.

23. A method for fabricating a sensing device comprising:

providing a first housing attached to a coupling having an inlet, the first housing configured to house at least in part a condition responsive actuatable sensing element, the actuatable sensing element having a first end and a second end, the first end in communication with the inlet;

providing a second housing mounted with respect to the first housing, the second housing including a groove configured to house at least in part an electrical mounting member, the electrical mounting member: (i) having a top side and a bottom side, and (ii) having a first switch and a second switch secured to the bottom side of the electrical mounting member, the first switch including a first switch actuator and the second switch including a second switch actuator;

wherein the second housing has a proximal side defining a first horizontal plane and a bottom side defining a second horizontal plane, and wherein the groove is angled relative to at least one of the first and second horizontal planes;

positioning the electrical mounting member within the angled groove;

rotating the electrical mounting member within the angled groove without moving the electrical mounting member in the axial direction of the electrical mounting member and by rotating the electrical mounting member with respect to the second housing to thereby adjust the heights of the first and second switch actuators relative to: (i) one another, and (ii) the second end of the actuatable sensing element;

securing the second housing relative to the first housing after the desired position of the electrical mounting member has been determined by a user; and securing the electrical mounting member with respect to the second housing after the desired position of the electrical mounting member has been determined by the user.

24. The method of claim 23, further comprising a retaining member positioned above the electrical mounting member, the retaining member configured and dimensioned to maintain the secured electrical mounting member in the groove.

25. The method of claim 24, wherein the retaining member is a retaining ring or a spring clip.

26. The method of claim 23, wherein the groove is angled from about 0.25 degrees to about 0.75 degrees relative to at least one of the first and second horizontal planes.

27. The method of claim 23, wherein the groove travels approximately 360° around the inner portion of the second housing.

28. The method of claim 23, wherein the actuatable sensing element is configured to actuate in response to condition changes: (i) received at the inlet and (ii) to which the actuatable sensing element is sensitive; and wherein the desired position of the electrical mounting member allows the first and second switch actuators to change state at substantially the same time upon actuation of the actuatable sensing element.

29. The method of claim 28, wherein the first and second switch actuators change state within a tolerance of about 0.00005 inches height difference between the first and second switch actuators relative to the second end of the actuatable sensing element.

30. The method of claim 23, wherein the electrical mounting member is secured with respect to the second housing by sealing the electrical mounting member with a sealant.

* * * * *